United States Patent [19]

Koch et al.

[11] Patent Number: 4,509,419

[45] Date of Patent: Apr. 9, 1985

[54] WORM PRESS FOR MECHANICALLY SEPARATING LIQUID/SOLID MIXTURES

[75] Inventors: Klaus Koch; Hans-Joachim Schaeffer, both of Laatzen; Gerhard Syrbius, Grossburgwedel, all of Fed. Rep. of Germany

[73] Assignee: Hermann Berstorff Maschinenbau GmbH, Hanover, Fed. Rep. of Germany

[21] Appl. No.: 552,318

[22] Filed: Nov. 16, 1983

[30] Foreign Application Priority Data

Nov. 20, 1982 [DE] Fed. Rep. of Germany ..... 3242999

[51] Int. Cl.[3] ..... B30B 9/14

[52] U.S. Cl. ..... 100/117; 100/145; 100/150

[58] Field of Search ..... 100/117, 145, 146, 147, 100/148, 149, 150; 56/1

[56] References Cited

U.S. PATENT DOCUMENTS

| | | | |
|---|---|---|---|
| 1,640,342 | 8/1927 | Anderson | 100/145 |
| 2,607,679 | 8/1952 | Weiss et al. | 100/147 X |
| 3,518,936 | 7/1970 | Bredeson | 100/117 |
| 3,592,128 | 7/1971 | French | 100/150 X |
| 4,436,502 | 3/1984 | Nelson et al. | 100/147 X |

*Primary Examiner*—Peter Feldman

*Attorney, Agent, or Firm*—Schwartz, Jeffery, Schwaab, Mack, Blumenthal & Koch

[57] ABSTRACT

A worm press for mechanically separating liquid/solid mixtures comprising a feed region and a pin-barrel pressing region. The worm has at least one flight, each of which flights is interrupted so as to enable the flight to pass the stationary pins in the pin-barrel region. The downstream ends or points of the worm flight portions formed by the interruptions are specially shaped in order to increase considerably the strength and service-life of the highly stressed points. This is achieved by reducing the size of the thrust flank, so that the flank subtends an angle of from 20° to 50° relative to the line perpendicular to the worm axis. Desirably, the thus-angled profiled tip region of the flight portions are interchangeable.

11 Claims, 7 Drawing Figures

Fig.5
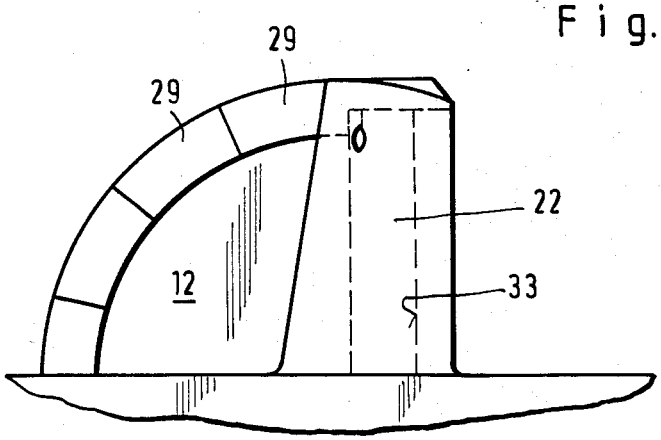
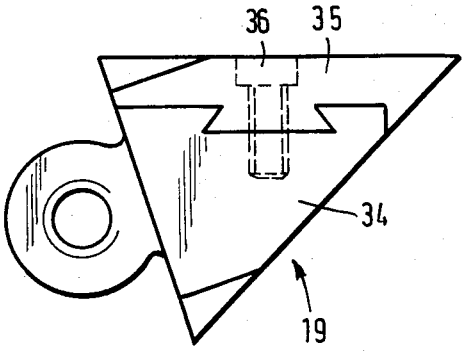
Fig.6
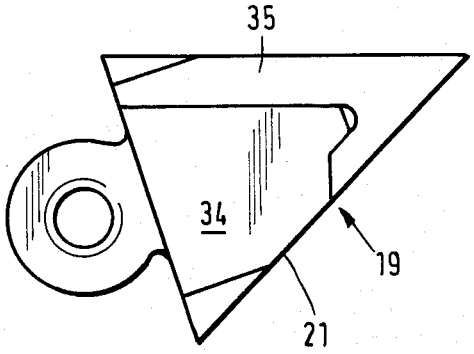
Fig.7

WORM PRESS FOR MECHANICALLY SEPARATING LIQUID/SOLID MIXTURES

FIELD OF THE INVENTION

The present invention relates to a worm press for mechanically separating solid/liquid mixtures. More particularly, the present invention relates to a worm press of the type which comprises a feed section and a pin-barrel pressing section. Such a device is disclosed in German Offenlegungsschrift No. 3 043 194.

DESCRIPTION OF THE PRIOR ART

It has, however, been found that such a known device suffers from wear problems under certain circumstances. For example, such problems may arise if liquid is being extracted from mixtures contaminated by sand, small stones, metal particles or the like.

A further feature of such a known device is that pins extend into the barrel chamber. These pins are needed to increase the throughput and efficiency of the extraction device. However, in so doing, weakened areas are produced on the worm flights, which latter are necessary for feeding or pressing the material. These weaknesses appear at the gaps which must be provided in the flights to permit the flights to pass the stationary pins when the worm is rotated.

In order to achieve an effective throughput, the worm flights, which are helically disposed on the worm core should have a pitch angle of approximately 17° relative to a line perpendicular to the worm axis. Pitch angles of, for example, 45° only permit material to be fed by the worm threads if the power input is considerably increased relative to the power input necessary if a pitch angle of 17° is employed. If the worm flight has a pitch angle of approximately 17°, the pitch of the worm corresponds substantially to the worm diameter.

If the worm flight is interrupted so as to avoid the stationary pins extending into the barrel chamber, the flight terminates, at the interruption, in a long point. The flights are interrupted in a direction at right angles to the worm axis.

These flight points are subjected to a high degree of wear. Moreover, they also have a tendency to fracture if, for example, small stones, metal particles or similar objects are contained in the mixture from which liquid is being extracted and such objects become wedged between the stationary pins and the flight points. These fractured flight pieces can, in turn, cause further damage in the subsequent pin plane because they form additional particles which may become trapped. Accordingly, more flight points may fracture or even the stationary pins themselves may be fractured if such pieces are conveyed further and reach the thrust flanks of the subsequent flight points.

In addition, the fractured flight points also cause damage to the inner wall of the barrel. Accordingly, in an extremely short period of time, the entire separating device may become considerably damage or even unusable. At best, one or more barrels, worms and/or pins need to be replaced.

OBJECTS OF THE INVENTION

The present invention seeks to provide a device of the abovementioned type but in which the disadvantages have been overcome. More particularly, the present invention seeks to provide a device in which the forwardmost flanks of the flight portions taken in the direction of rotation of the worm, are less liable to fracture and in which the wear phenomena at these locations are circumvented.

BRIEF SUMMARY OF THE INVENTION

According to the present invention, there is provided a worm press for mechanically separating liquid/solid mixtures, said worm press comprising a material feed region and a pressing region downstream, in the direction of material flow, of said feed region, hollow barrel means extending along and defining said feed and said pressing regions, a rotatable worm disposed within said barrel, pin means projecting radially inwardly from said barrel towards the axis of rotation of said worm, in said pressing region, said pin means being equiangularly spaced around the periphery of said barrel, said worm including at least one helical flight formed thereon, each said flight being radially interrupted in each said region of said pin means so as to define a plurality of flight portions, each said flight portion having, in said direction of material flow, an upstream end region and a downstream end region, said downstream end of each said flight portion terminating in a profiled tip portion, said tip portion comprising a shearing or break-through flank portion extending substantially at right angles to said axis of rotation of said worm and a thrust flank portion, said thrust flank portion subtending an acute angle with said shearing or break-through flank, wherein said thrust flank subtends an angle of from 20° to 50° relative to a line extending perpendicularly to said worm axis of rotation.

It has surprisingly been found that, by increasing the angle which the thrust flank subtends with a line extending perpendicularly to the worm axis, which means that the tip portion of the flight, immediately downstream in the direction of material flow of a pin, is shorter, the throughput produced by the pin and worm flight is maintained. It has hitherto been believed that the length of the thrust flank determines the throughput and the build-up of pressure. By reducing the length of the tip or point, the strength of the tip or point is greatly increased. It has been found that a reduction in the angle subtended by the thrust flank at the line perpendicular to the worm axis to 20° provides a considerable increase in strength. The optimumresults, however, taking into account both the strength of the point or tip and the throughput, were achieved with an angle of 35°.

If particularly hard impurities, such as stones or similar objects, are present in the material from which liquid is being extracted, an angle of as much as 50° may be necessary to prevent fracturing of the points.

Desirably, said profiled tip portion is detachably affixable to said flight of said worm. In such an arrangement the reduction of the length of the thrust flank, by increasing the angle which the thrust flank subtends with a line perpendicular to the worm axis, which angle is selected in dependence upon the nature of the material from which liquid is being extracted, ensures that the tips or points of the flights do not become deformed or fracture. On the other hand, the interchangeable nature of the pointed profile makes it possible to eliminate, or at least minimise, the wear phenomena at the points or tips.

It is desirable if highly wear-resistant materials such as stellite and tungsten carbide are used for manufacturing the pointed profiles.

Preferably, said detachably affixable profile carries a countersunk pin or journal integrally formed with said profile, said pin or journal being located in the region of said profile remove from said convergence of said shearing or break-through and said thrust flanks, said worm care defining receiving means for receiving said countersunk pin or journal.

A round countersunk pin is integrally formed with the interchangeable pointed profile at the end of the profile remote from the point, that is to say, on the rear support surface which is disposed against the flight frustum. This arrangement permits the pointed profile to be fully supported against the flight frustum. A high degree of stability is thus achieved.

The support of the pointed profile is further enhanced if a flight support surface is permitted to remain on either side of such pin. These surfaces prevent the pointed profile from pivoting around the pin. The appropriate selection of the angle of such flight support surfaces remaining on either side of the pin permits the use of pointed profiles for very different types of loading. Since the force acting upon the pointed profile when a solid object is located between the shearing or break-through flank of the profile and the stationary pin of the pin-barrel section has components urging the profile in the direction of the worm axis and also in the direction of the flight pitch, the appropriate support angle is selected in dependence upon the pressure acting on the flight frustum.

Such angle is, of course, dependent on the extent to which the material from which the liquid is being extracted is contaminated with hard components. The angle of the pointed profile relative to the surface of the flight frustum, that is to say, relative to the worm axis, needs to be large if there are many such components so as to achieve greater stability, and hence a longer service-life, for the interchangeable pointed profile.

Further desirably, said profiled tip portion defines a step-like recess, said recess being disposed above said round pin, and said flight of said worm includes a ridge portion. An interchangeable wear segment is located in said recess, said segment covering and filling said recess said being mounted on said flight ridge portion. The pointed profile is inserted by means of its integrally moulded round pin, into the round bore provided in the worm core. Subsequently, a wear segment which fits into, and fills, the rear, step-like recess of the pointed profile is screw-connected to the flight ridge by means of hollow screws, whereby the pointed profile is simultaneously retained in position.

To permit more satisfactory compensation of the wear of the pointed profile, it is particularly advantageous if said profiled tip portion comprises a support member, said shearing or break-through flank of said profiled tip portion being separate from but connected to said support member.

Alternatively or additionally, said countersunk pin member is integrally formed with said support member, said support member being formed from a tough, non-brittle metal, and said shearing or break-through flank portion connected to said support member is formed from a wear-resistant material, said shearing or break-through flank portion extending around the tip of said profile so as to form part of said thrust flank. The profile may thus be formed from two components made of different materials, that is to say the shearing break-through flank portion and the support member together with the countersunk pin. Moreover, the support member and the shearing or break-through flank portion may be connected by welding, by a screw-connection or by a tongue and groove connection.

In order to permit, on the one hand, the better use of the properties of a wear-resistant metal, without having to tolerate the disadvantages of these metals, namely their relatively high degree of brittleness and friability, the support member for the pointed profile may be formed from a metal such as iron. The highly wear-resistant metal portion is connected to the support member so that a pointed profile is produced in which the shearing flank has a high degree of wear resistance whilst the support member has a certain amount of resilience.

BRIEF DESCRIPTION OF THE DRAWINGS

Various embodiments of the present invention will be further described, by way of example, with reference to the accompanying drawings, in which:

FIG. 5 is a cross-sectional view taken along the line V—V of FIG. 3; and FIG. 6 and FIG. 7 are, respectively, plan views of two further embodiments of the pointed profile.

DESCRIPTION OF PREFERRED EMBODIMENTS

Figure 1:
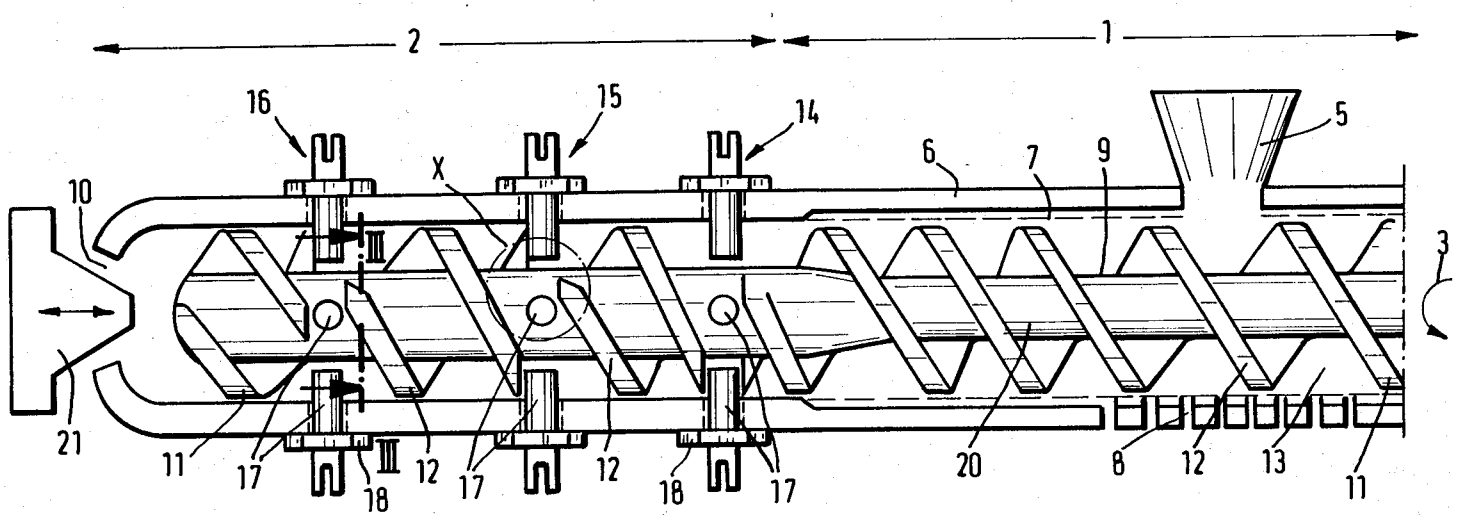
FIG. 1 is a schematic longitudinal sectional view through a worm press for separating liquid/solid mixtures.

In FIG. 1 there is shown a worm press comprising a feed section 1 and a pin-barrel section 2. The feed section 1 comprises a material feed hopper 5, a worm barrel 6 having axially extending grooves 7 formed therein, and filter apertures 8. The worm 9 is disposed in the barrel 6 and is rotated by means of a drive unit (not shown). Such rotation causes the material introduced through the hopper 5 to be passed through the pin-barrel region 2 to an outlet aperture 10. Helical flights 11 and 12 are disposed on the worm 9, and a thread 13 is defined between the flights.

The worm flights 11 and 12 are interrupted in the pin-barrel region 2 of the press, the axial length of such interrupted portions corresponding substantially to the diameter of cylindrical pins 17 projecting through the wall of the barrel 6 into the interior thereof. Three pin planes 14, 15 and 16 are shown in FIG. 1, each plane comprising a plurality of pins 17, each of which are directed towards the axis of the worm. The pins 17 in each plane 14, 15 and 16 are substantially equiangularly disposed around the periphery of the barrel 6. The ends of the pins, which project into the interior of the barrel, may be cylindrical, rectangular or bevelled so as to provide a cutting or shearing action on the material being forwarded by the worm. The pins are screwed into the barrel 6 and are fixed in position by means of nuts 18.

The depth to which the pins project into the barrel 6 may be varied in dependence upon the material being extruded. Thus, for example, if all of the pins 17 are screwed deeply into the barrel 6, this prevents, to a large degree, the material being extruded from rotating with the worm 9. This increases the throughput of the worm considerably. With increasing throughput, the pressure build-up in the pin-barrel region 2 also increases, as does the extrusion output.

In order to maintain or even increase further the pressure, the outlet aperture 10 may be sealed by a pressure-loaded cone 21. The cone 21 opens the outlet aperture 10 in a slot-like manner when a pre-selected pressure is reached. The pressure at which this occurs can be set in dependence upon the material being extruded.

Figure 2:
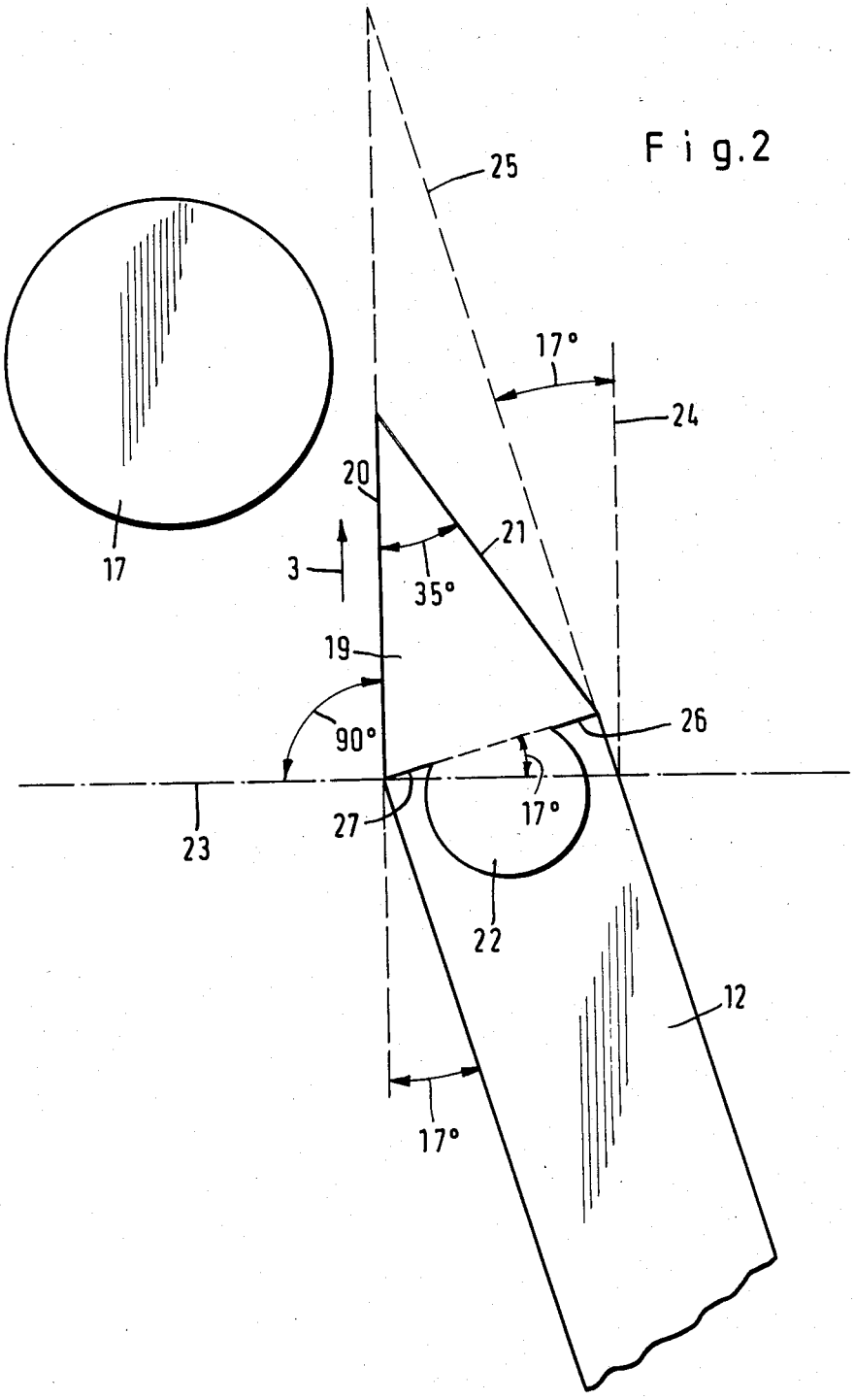
FIG. 2 is a schematic detail of the ringed portion X shown in FIG. 1.

In the detail shown in FIG. 2, which corresponds to the ringed region X shown in FIG. 1, the flight 12 of the worm is shown more clearly. As previously stated, the flight 12 of the worm is interrupted in the pin region 17. From FIG. 2, it can be seen that the tip portion of the flight 12 which, in the direction of transfer of the material, is rearward of the pin 17, has a pointed profile 19. The tip of the profile is defined by a shearing flank 20 and a thrust flank 21. The direction of rotation of the worm is indicated by arrow 3, and the pointed profile 9 moves past the stationary pin 17. A countersunk pin 22 is moulded integrally with the pointed profile 19.

In FIG. 2, it can be seen that the thrust flank 21 subtends an angle of 35° with a line 24 extending perpendicularly to the worm axis 23, and the flight 12 has a pitch angle of 17°. To produce the angle of 35°, the tip portion of the flight has to be cut away and the imaginary uncut tip 25 is indicated by dotted lines.

The end region of the pointed profile 19 remote from the tip of the profile abuts against the worm flight 12 by means of two support surfaces 26 and 27. As can be seen from FIG. 2, these support surfaces subtend an angle of 17° with the worm axis 23.

Figure 3:
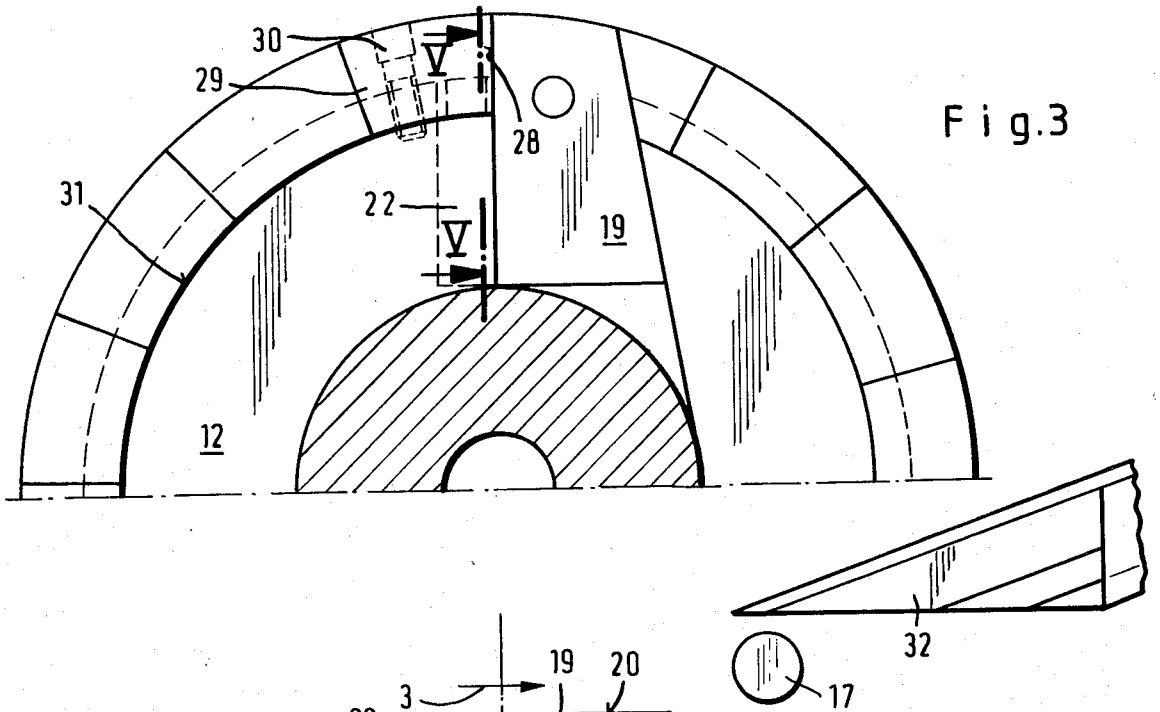
FIG. 3 is a cross-sectional view through the worm press taken along the line III—III of FIG. 1, such worm being provided with a pointed profile.

The cross-sectional view of FIG. 3 shows the relationship between the pointed profile 19 and the pin 22. In addition, the pointed profile 19 has a step-like recess 28 formed therein which assists in retaining the profile 19 on the flight 12. Thus, a wear segment 29 rests upon the recess 28 and forms an arcuate line at the top which is flush with the pointed profile 19. The wear segments 29 are screwed into the ridges 31 of the flights 12 by means of hollow screws 30 and thus retain the pointed profile 19 in position.

Figure 4:
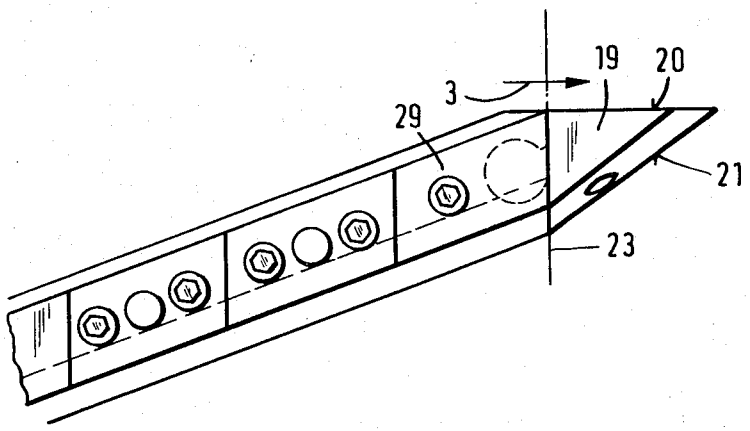
FIG. 4 is a plan view of a development of the worm flight shown in FIG. 3 and shows the nature of the pointed profile.

FIG. 4 is a plan view of a development of the worm flight shown in the cross-sectional view of FIG. 3. Thus, it shows the pointed profile 19 and the wear segments 29 as viewed from above. Arrow 3 indicates the rotational direction of the worm, and it is also apparent from this Figure that the pointed profile 19 is disposed on the forward or commencement portion of the flight. The end 32 of the flight opposed to the profile 19 on the other side of the interruption, that is to say, the rearward end of the next portion of the flight 12, does not need to be similarly tapered because it is not subjected to heavy loading and consequently is not liable to fracture.

In the cross-sectional view shown in FIG. 5, the countersunk pin 22 and a bore 33 provided in the ridge of the flight are visible, as are the wear segments 29 which extend along the flight 12.

In the plan view of a second embodiment of the pointed profile shown in FIG. 6, the profile 19 is shown as comprising a support member 34 and a shearing or break-through flank portion 35 which is securely screw-connected to the member 34 by means of a hollow screw 36.

In the embodiment shown in FIG. 7, the shearing or break-through flank portion 35 of the profile has been welded onto the support member 34 and extends around the point of the profile. The flank portion 35 thus partially covers the thrust flank 21 with a wear-resistant material.

We claim:

1. A worm press for mechanically separating liquid/-solid mixtures, said worm press comprising a material feed region and a pressing region downstream, in the direction of material flow, of said feed region, hollow barrel means extending along and defining said feed and said pressing regions, a rotatable worm disposed within said barrel, pin means projecting radially inwardly towards the axis of rotation of said worm from said barrel in said pressing region, said pin means being spaced around the periphery of said barrel, said worm including at least one helical flight formed thereon, said flight being radially interrupted in the region of said pin means so as to define a plurality of flight portions, each said flight portion having, in said direction of material flow, an upstream end region and a downstream end region, said downstream end of said flight portion terminating in a profiled tip portion, means for detachably affixing said profiled tip portion to the adjacent flight portion, said tip portion comprising a shearing flank portion extending substantially at right angles to said axis of rotation of said worm, and a thrust flank portion subtending an acute angle with said shearing flank portion, said thrust flank subtending an angle of from 20° to 50° relative to a line extending perpendicularly to said worm axis of rotation.

2. A worm press as recited in claim 1 wherein said profiled tip portion is formed from a wear-resistant material selected from the group consisting of stellite and tungsten carbide.

3. A worm press as recited in claim 1, wherein said detachably affixable profile carries a countersunk pin integrally formed with said profile, said pin means being located in the region of said profile remote from said convergence of said shearing and thrust flanks, said worm core defining receiving means for receiving said countersunk pin means.

4. A worm press as recited in claim 3, wherein said profiled tip portion defines a step-like recess, said recess being disposed above said countersunk pin, and an interchangeable wear segment located in said recess, said segment covering and filling said recess and being mounted on a ridge portion of said worm.

5. A worm press as recited in claim 3, wherein said region of said interchangeable pointed profile carrying said countersunk pin further includes flight support surfaces disposed on each side of said countersunk pin, such flight support surfaces being disposed at an angle of between 0° and 45° to said worm axis of rotation.

6. A worm press as claimed in claim 1, wherein said profiled tip portion includes a support member, said shearing flank of said profiled tip portion being separate from but connected to said support member.

7. A worm press as recited in claim 6, wherein said countersunk pin is integrally formed with said support member, said support member being formed from a tough, non-brittle metal, and said shearing flank portion connected to said support member is formed from a wear-resistant material, said shearing flank portion extending around the tip of said profile so as to form part of said thrust flank.

8. A worm press as recited in claim 6, wherein said connection between said support member and said shearing flank portion is effected by welding.

9. A worm press as recited in claim 6, wherein said connection between said support member and said shearing flank portion is effected by a screw connection.

10. A worm press as recited in claim 6, wherein said connection between said support member and said shearing flank portion is effected by a tongue and groove connection.

11. A worm press as recited in claim 6, wherein the acute angle between said shearing flank and thrust flank portions of said profiled tip portion is approximately 35°.

* * * * *